US010208499B2

(12) United States Patent
Lovell et al.

(10) Patent No.: US 10,208,499 B2
(45) Date of Patent: Feb. 19, 2019

(54) COVER ASSEMBLY FOR AN INFANT BED

(71) Applicants: Emma Lovell, Arlington, VA (US); Phillip Lovell, Arlington, VA (US)

(72) Inventors: Emma Lovell, Arlington, VA (US); Phillip Lovell, Arlington, VA (US)

( * ) Notice: Subject to any disclaimer, the term of this patent is extended or adjusted under 35 U.S.C. 154(b) by 459 days.

(21) Appl. No.: 13/869,022

(22) Filed: Apr. 23, 2013

(65) Prior Publication Data

US 2013/0291918 A1 Nov. 7, 2013

(51) Int. Cl.

| | |
|---|---|
| ***E04H 15/02*** | (2006.01) |
| ***A47C 29/00*** | (2006.01) |
| ***E04H 15/36*** | (2006.01) |
| ***E04H 15/40*** | (2006.01) |
| ***A47D 7/00*** | (2006.01) |
| *A47D 15/00* | (2006.01) |

(52) U.S. Cl.

CPC ..... *E04H 15/02* (2013.01); *A47C 29/003* (2013.01); *A47D 7/007* (2013.01); *E04H 15/36* (2013.01); *E04H 15/405* (2013.01); *A47D 15/00* (2013.01); *Y10T 29/49826* (2015.01)

(58) Field of Classification Search

CPC ..... E04H 15/02; E04H 15/36; E04H 15/40; E04H 15/54; E04H 15/64; E04H 15/006; E04H 15/324; A47C 29/006; A47C 29/003; A47D 7/00; A47D 7/007; A47D 15/00; A47D 15/02

USPC ..... 135/96, 125–126, 136–137, 148, 151, 135/161, 119; 5/93.1, 97–98.1, 113, 5/414–415; 29/428

See application file for complete search history.

(56) References Cited

U.S. PATENT DOCUMENTS

| | | | | | |
|---|---|---|---|---|---|
| 3,848,279 | A * | 11/1974 | Ipsen, Jr. | A47C 17/70 | 135/117 |
| 4,825,892 | A * | 5/1989 | Norman | E04H 15/40 | 135/126 |
| 5,137,044 | A * | 8/1992 | Brady | E04H 15/56 | 135/126 |
| 5,517,707 | A * | 5/1996 | LaMantia | A47C 29/003 | 135/96 |
| 5,676,168 | A * | 10/1997 | Price | E04H 15/40 | 135/125 |
| 5,862,548 | A * | 1/1999 | Gerhart | A47D 13/06 | 135/117 |
| 6,109,280 | A * | 8/2000 | Custer | A47C 29/006 | 135/116 |
| 6,192,909 | B1 * | 2/2001 | Strausser | E04H 15/40 | 135/116 |
| 6,318,394 | B1 * | 11/2001 | Zheng | A63B 9/00 | 135/125 |
| 6,325,086 | B1 * | 12/2001 | Shinner | E04H 15/40 | 135/117 |
| 6,467,107 | B1 * | 10/2002 | Glover | A47C 7/66 | 135/125 |
| 6,644,329 | B2 * | 11/2003 | Tomason | E04H 15/324 | 135/90 |

(Continued)

*Primary Examiner* — Winnie Yip

(74) *Attorney, Agent, or Firm* — Berg Hill Greenleaf Ruscitti, LLC

(57) ABSTRACT

A cover assembly for an infant bed comprising a frame assembly adapted for mounting to the infant bed, a panel assembly supported by the frame assembly to define a covered area generally above the infant bed and extending around the periphery of the infant bed in use and a window panel for closing the opening.

8 Claims, 9 Drawing Sheets

(56) References Cited

U.S. PATENT DOCUMENTS

| | | | | |
|---|---|---|---|---|
| 6,811,204 | B2 * | 11/2004 | Long | E04H 15/40 135/88.05 |
| 6,848,460 | B2 * | 2/2005 | Zheng | E04H 15/324 135/126 |
| 7,174,584 | B2 * | 2/2007 | Danaher | E04H 15/40 135/126 |
| 7,954,504 | B2 * | 6/2011 | Price | E04H 15/425 135/119 |
| 8,671,963 | B2 * | 3/2014 | Shih | E04H 15/04 135/137 |
| 2011/0035877 | A1 * | 2/2011 | Biddle | A47C 29/006 5/93.1 |
| 2014/0208504 | A1 * | 7/2014 | Do | A47D 15/00 5/99.1 |

* cited by examiner

COVER ASSEMBLY FOR AN INFANT BED

FIELD OF THE INVENTION

The present invention relates to a cover assembly and in particular to a cover assembly for an infant bed.

The invention has been developed primarily for use with baby bassinets and will be described hereinafter with reference to this application. However, it will be appreciated that the invention is not limited to this particular field of use, and can also be used with other infant beds such as cots, portable cots, toddler beds, baby cradles, strollers, prams and pram bassinets.

BACKGROUND OF THE INVENTION

Parents and caregivers often find it difficult to travel with infants (babies and very young children) particularly on airplanes. Infants often have a routine as to when they eat and have a nap, and when distracted from this routine, can be very upset. Keeping an infant to a sleeping routine is particularly difficult on airplanes as there are many distractions for the infant such as noise, light and people.

The present invention seeks to address the above difficulties, or to at least provide an alternative approach to such difficulties.

It is to be understood that, if any prior art information is referred to herein, such reference does not constitute an admission that the information forms part of the common general knowledge in the art, in any country.

SUMMARY OF THE INVENTION

According to a first aspect, the present invention provides. A cover assembly for an infant bed, the cover assembly comprising:

a frame assembly adapted for mounting to the infant bed; and a panel assembly supported by the frame assembly to define a covered area generally above the infant bed and extending around the periphery of the infant bed in use.

Preferably, the frame assembly comprises mounting means for mounting the frame assembly to the infant bed.

Preferably, the mounting means comprises attachment means for attachment to generally opposite edges of the infant bed.

Preferably, the attachment means are adapted to attach to upper edges of the infant bed.

Preferably, the mounting means comprises at least two clips

In one embodiment, the frame assembly comprises a top frame and first and second side frames attached to the top frame, each side frame having the mounting means.

Preferably, the side frames are pivotally connected to the top frame.

Preferably, the frame assembly further comprises side frames.

Preferably, the panel assembly comprises at least one panel extending over the frame assembly in use.

In one embodiment, the panel assembly comprises a top panel, a rear panel, side panels and a front panel.

Preferably, the rear and front panels each include expansion portions such that these panels retain their connection to the side panels if the frame assembly is expanded.

Preferably, the front panel comprises a first section having an opening, and a window panel for closing the opening.

Preferably, side and lower edges of the window panel are attachable to the first section.

Preferably, the panel assembly is made from a flexible breathable material.

Preferably, free edges of the panel assembly comprise means for temporary attachment to the infant bed.

Alternatively, free edges of the panel assembly can comprise edge weights.

In another embodiment, the panel assembly comprises an overlap portion.

Preferably, the cover assembly is foldable or collapsible.

In another embodiment, the frame assembly comprises a flexible panel having the mounting means at opposing edges thereof.

Preferably, the panel comprises an opening.

In another embodiment, the frame assembly comprises a wire frame.

In another embodiment, the frame assembly comprises two flexible members arranged in an X configuration and having the mounting means at each end thereof.

The present invention in another aspect provides a cover assembly for an infant bed, the cover assembly comprising:

a frame;

a panel assembly supported by the frame, the panel assembly dimensioned to in use provide a covered area above the infant bed and extending around the periphery of the infant bed; and a mounting means for attaching the frame and/or the panel assembly to an upper structure.

Preferably, the mounting means comprises a connector connecting the frame and/or the panel assembly to a mount.

Preferably, the mount comprises a suction cup.

Preferably, the mount is further attached to a safety clip via the connector.

The present invention in another aspect provides a method of providing a covered area to an infant bed, the method comprising:

mounting a frame to the infant bed, disposing a panel assembly over the frame to create the covered area above the infant bed and around the periphery thereof.

Other aspects of the invention are also disclosed.

BRIEF DESCRIPTION OF DRAWINGS

Notwithstanding any other forms which may fall within the scope of the present invention, preferred embodiments of the present invention will now be described, by way of examples only, with reference to the accompanying drawings in which.

DETAILED DESCRIPTION OF THE INVENTION

Figure 1:
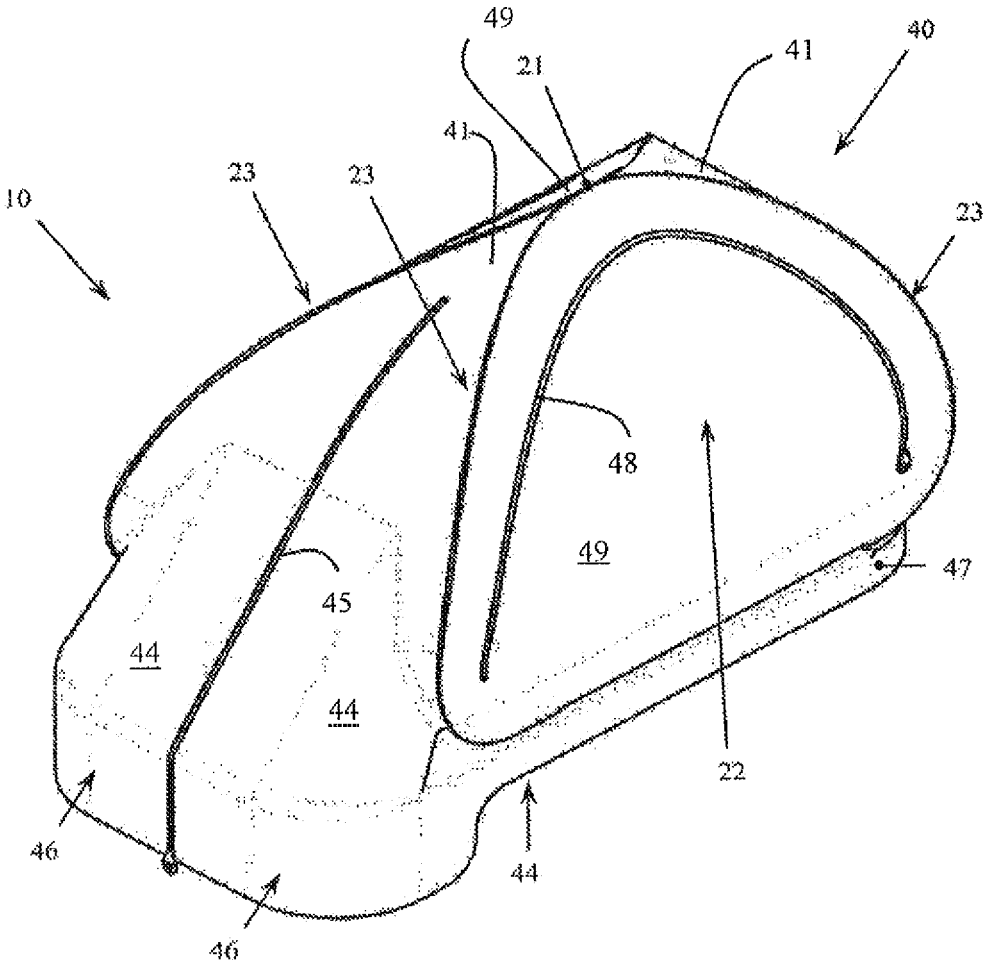
FIG. 1 is a front perspective view of a cover assembly in accordance with a preferred embodiment of the present invention attached to the top of a bassinet with a window panel of the cover assembly in the closed configuration.
Figure 2:
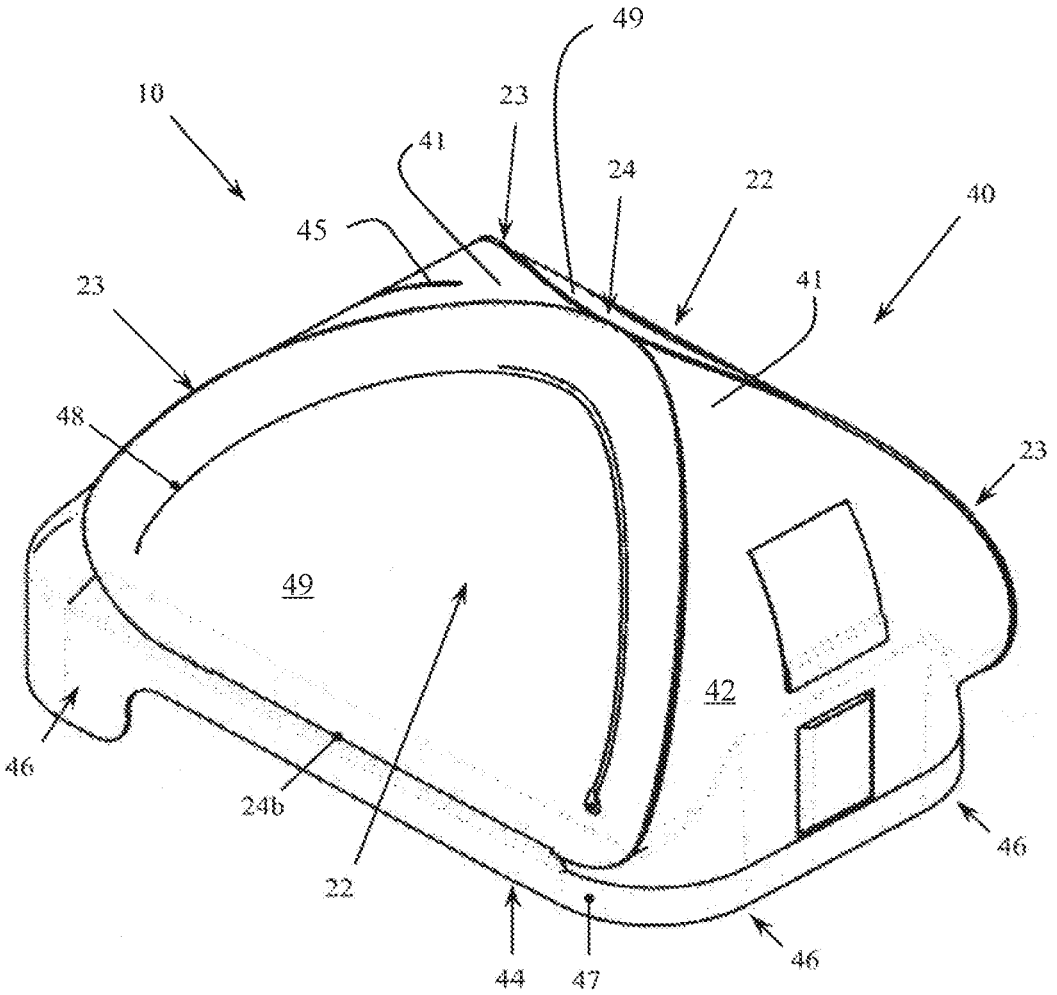
FIG. 2 is a rear perspective view of the cover assembly of FIG. 1 with the window panel in the closed configuration.
Figure 3:
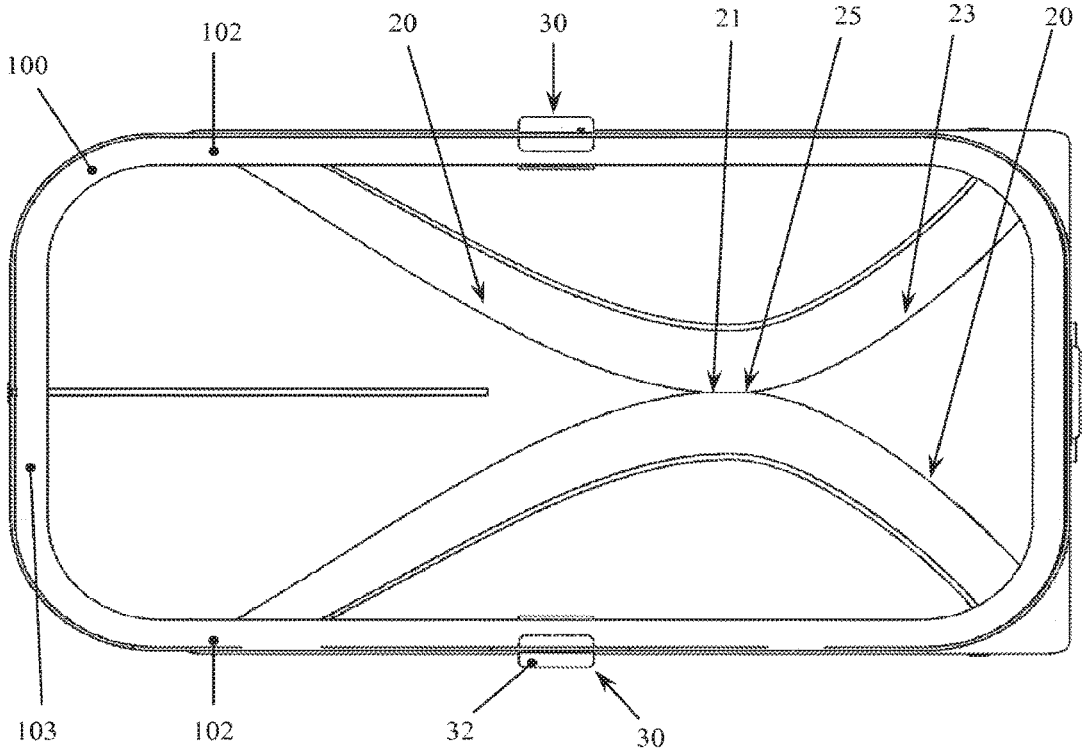
FIG. 3 is a bottom plan view of the cover assembly of FIG. 1 attached to the top edge periphery of a bassinet.
Figure 4:
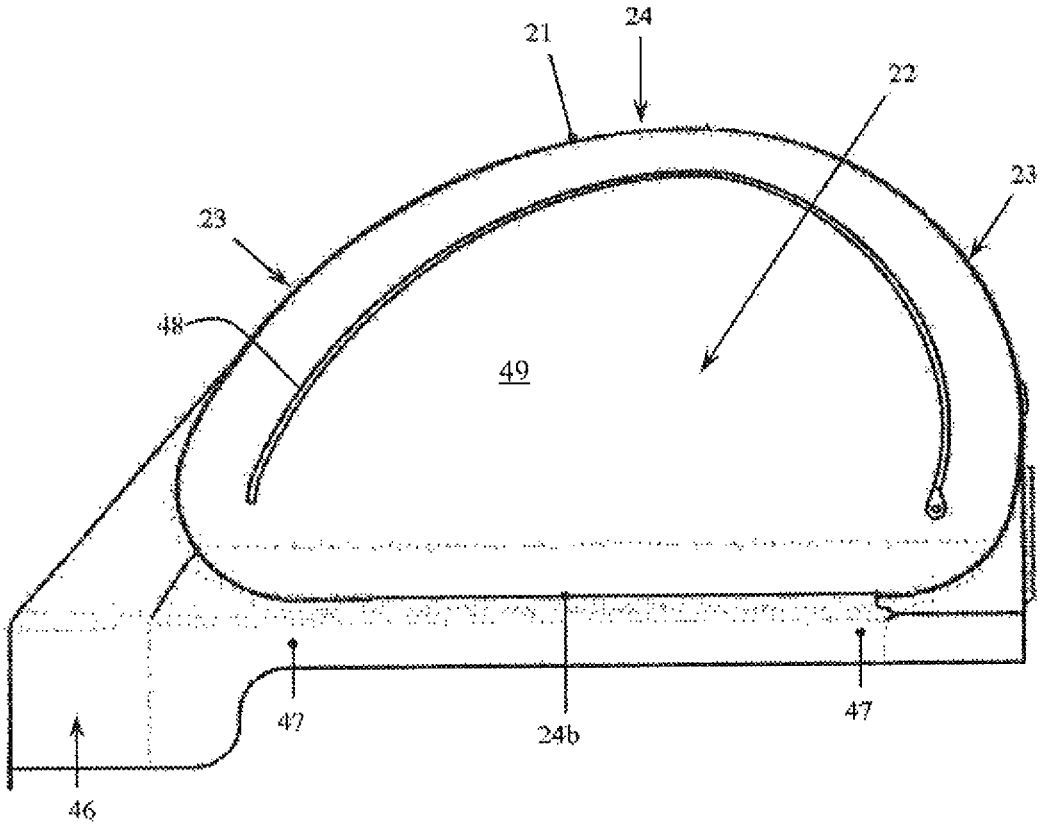
FIG. 4 is a side view of the cover assembly of FIG. 1.
Figure 5:
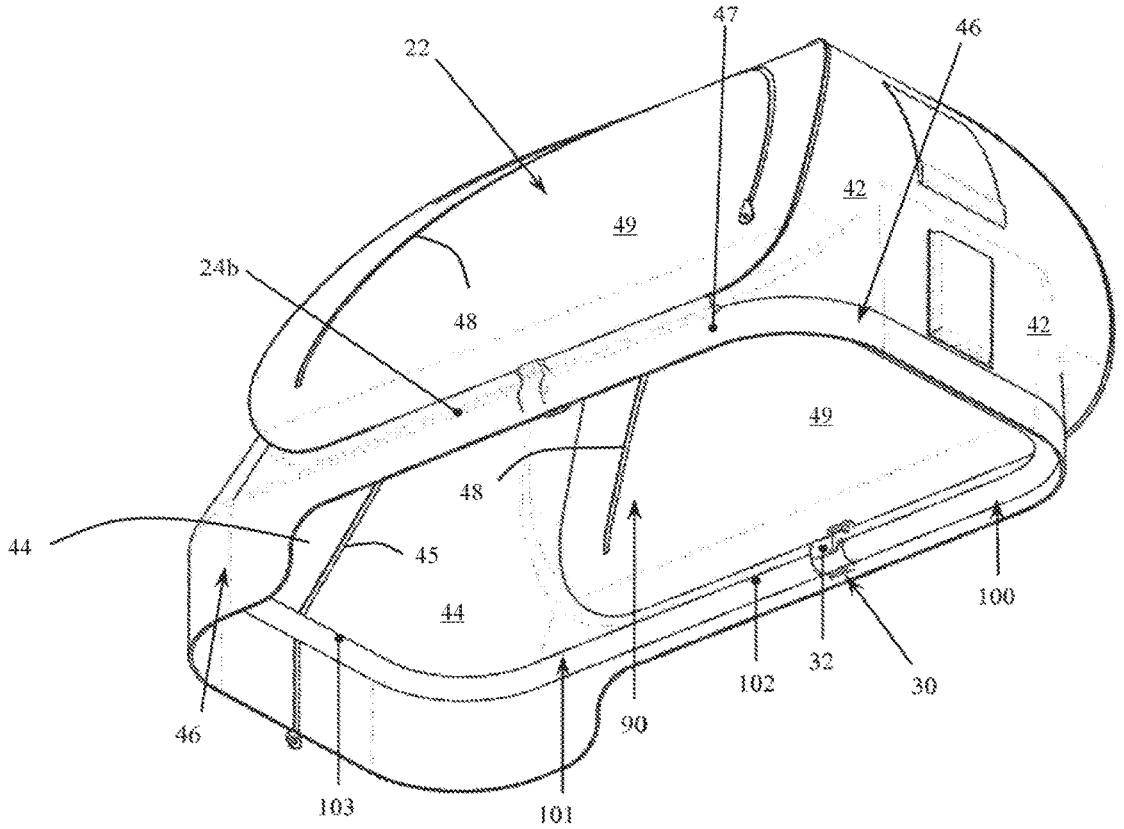
FIG. 5 is a bottom perspective view of the cover assembly of FIG. 1 attached to the top edge periphery of bassinet with the window panel in closed configuration.

It should be noted in the following description that like or the same reference numerals in different embodiments denote the same or similar features.

FIG. 1 to FIG. 4 show a cover assembly 10 in accordance with a preferred embodiment of the present invention. The cover assembly 10 comprises a frame assembly 20 having mounting means 30 for mounting the frame assembly 20 to an infant bed, such as a bassinet 100. The cover assembly 10 also comprises a panel assembly 40 supported by the frame assembly 20 to define a covered area 90 above the bassinet 100 in use, the covered area 90 extending around the periphery of the bassinet 100.

The frame assembly 20 comprises a top frame 21 and first and second side frames 22. Each of the top and side frames 21 and 22 are curved and include curved lateral members 23 and longitudinal members 24. The lower longitudinal members 24*b* of the side frames 22 each include the mounting means 30. The top and side frames 21 and 22 are open between their members 23 and 24, but can alternatively be solid panels if desired. The frame assembly can also further include side frames extending between the curved lateral members 23 if desired.

The top of the bassinet 100 includes a top edge periphery 101 which is generally rectangular and includes two parallel longitudinal edges 102 and parallel lateral edges 103. Most infant beds such as cots, portable cots, toddler beds, strollers, prams and pram bassinets have a top edge periphery 101 with this general configuration, although some bassinets and baby cradles have curved parallel lateral edges 103. The mounting means 30 in this embodiment comprises at least one clip 32 in each side frame 22 for attachment to a respective one of the longitudinal edges 102. As the side frames 22 are pivotally attached to the top frame 21, the distance between the lower longitudinal members 24*b* can be varied to suit the dimensions of the infant bed, whether it is a bassinet or a cot. When the frame assembly 20 is mounted to the top of an infant bed 100, the top frame 21 is spaced above the bed periphery 101.

Preferably, the lower longitudinal members 24*b* are of a length substantially equal to the longitudinal edges 102 of the top of the bassinet 100. The clips 32 can be any suitable clip that can be used for mounting the frame assembly 20 to the top of an infant bed 100. For example, the clips 32 can be bulldog clips, alligator clips, other suitable metal or plastics clip, or a customised clip. Other suitable mounting means can alternatively be used, such as brackets, loops, hooks, or flexible fasteners such as hook and loop fasteners (e.g. VELCRO™).

The panel assembly 40 comprises a top panel 41, a rear panel 42, side panels defined by triangular shaped window panels 49 and a two-piece front panel 44. The two piece front panel 44 includes an opening 45 for access to an infant. The top panel 41 is generally curved in shape and includes rear and front edges from which the rear and front panels 42 and 44 extend, and opposing side edges from which the window panels 49 extend. The top panel 41 is shaped and dimensioned to correspond to that of the top frame 21.

The panel assembly 40, supported by the frame assembly 20, extends to and around the top edge periphery 101 of the top of the bassinet 100 in use. The front 44, rear 42 and window panels 49 are preferably attached to the lower longitudinal members 24*b* of the frame assembly 20, although one or more of these panels can alternatively be free hanging downwardly. The rear and front panels 42 and 44 each include expansion portions 46 such that these panels retain their connection to the window panels 49 even if the frame assembly 20 is expanded.

The sides of the panel assembly further comprise a lower section 47. The window panel 49 comprises an opening 48 which is closable by a suitable closure means, such as hook and loop fastener, buttons, zippers or complementary magnetic means. The window panel 49 is generally curved in shape and is attached at a top portion thereof to the top panel 41 and at a lower portion thereof to the lower section 47. The window panel 49 is dimensioned to extend across and fully cover the opening 48. Similarly, the opening 45 may be closable by suitable closure means, such as hook and loop fastener, buttons, zippers or complementary magnetic means.

The cover assembly 10 is used with the top of a bassinet 100, whether the top of the bassinet 100 is free standing, attached to a pram, or in an airplane. The frame assembly 20 is mounted to the top of the bassinet 100 via the mounting means 30, which locates the panel assembly 40 over the bassinet 100 and creates a covered area 90 above the top of the bassinet 100 and around the top edge periphery 101 thereof. The panel assembly 40 is manufactured from a flexible material which is highly breathable and blocks out a majority of surrounding light. One example of such material includes a dual layer woven net material.

The provided covered area 90 assists infants in sleeping in the bassinet as the cover assembly 10 substantially prevents unwanted light from disturbing the infant during sleep. The window panel 49 provides access to the infant for checking on and handling of the infant. The window panel 49 can be rolled and placed over the top panel 41 for access to the bassinet and the infant via the opening 48, used to completely close the opening 48, or can be partially lifted for checking on the infant.

The cover assembly 10 is foldable into a relatively small package for easy transport and handling. The side frames 22 can be folded toward the top frame 21 to provide a generally flat transport configuration. One possible alternative is to have the frames 21 and 22 made from resilient spring steel which can be further folded into a smaller configuration by twisting the frames in a figure of '8' manner and folding the resulting halves over each other.

Figure 6:
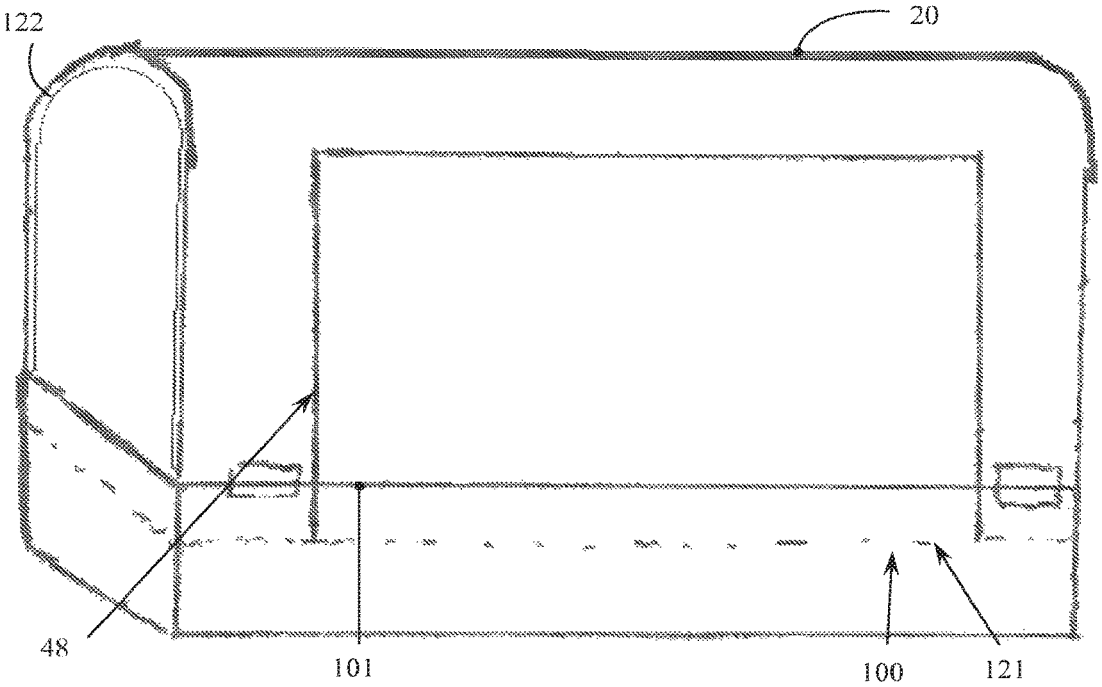
FIG. 6 is a perspective view of a frame assembly for a cover assembly in accordance with another preferred embodiment of the present invention mounted to a bassinet.
Figure 7:
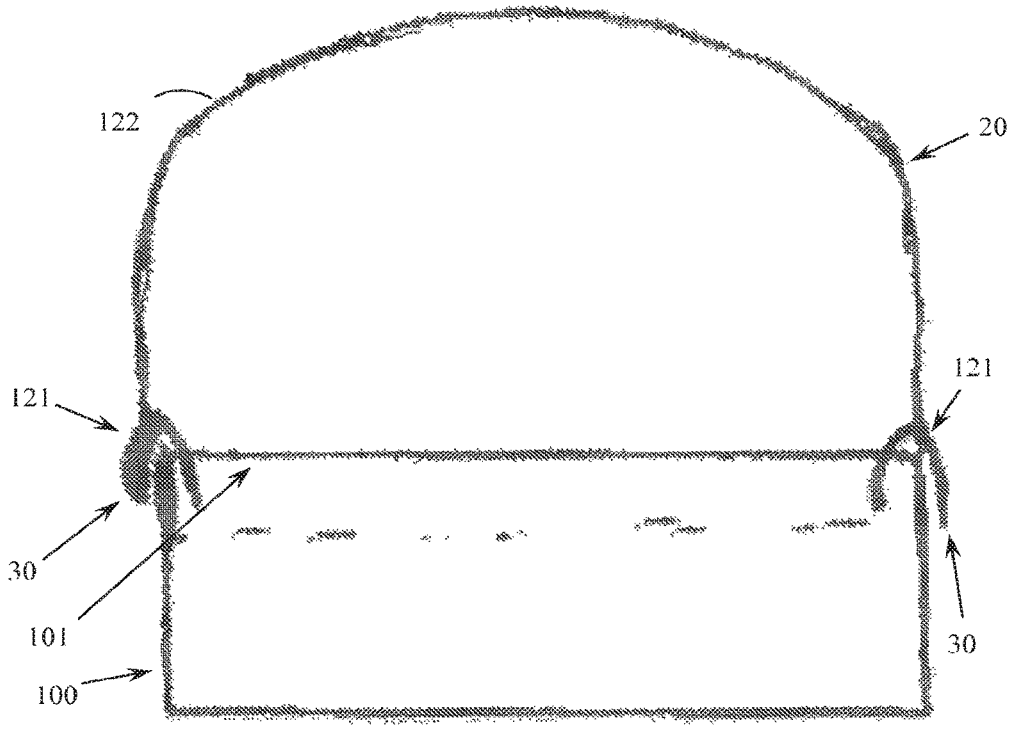
FIG. 7 is an end view of the frame assembly and bassinet of FIG. 6.
Figure 8:
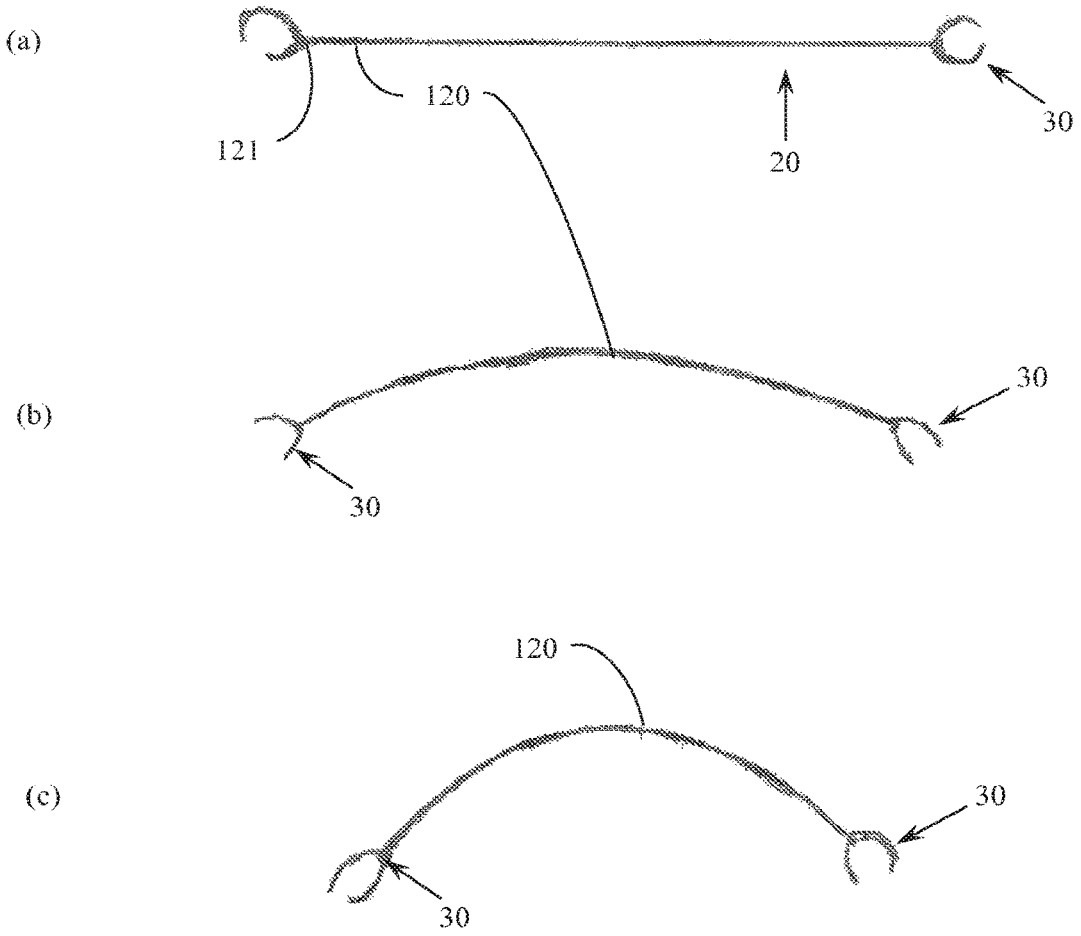
FIGS. 8 (*a*) to (*c*) are schematic diagrams of the frame assembly of FIG. 6.

FIG. 6 to FIG. 8 show an alternative embodiment of the frame assembly 20, which comprises a single flexible panel 120. The panel 120 comprises longitudinal edges 121 having the mounting means 30 and side edges 122. In use, the panel 120 is bent as shown in FIG. 8 with the mounting means 30 attached to the bassinet top edge periphery 101 to generally from a dome-like frame assembly 20. The panel 120 includes the opening 48 in one section thereof.

The panel 120 in another embodiment can have an opening 48 extending generally from one longitudinal edge 121 to the other longitudinal edge 121, to provide a wire frame. Such a wire frame can then be collapsible by folding same into a figure of '8' configuration and folding the two resulting halves to each other.

Figure 9:
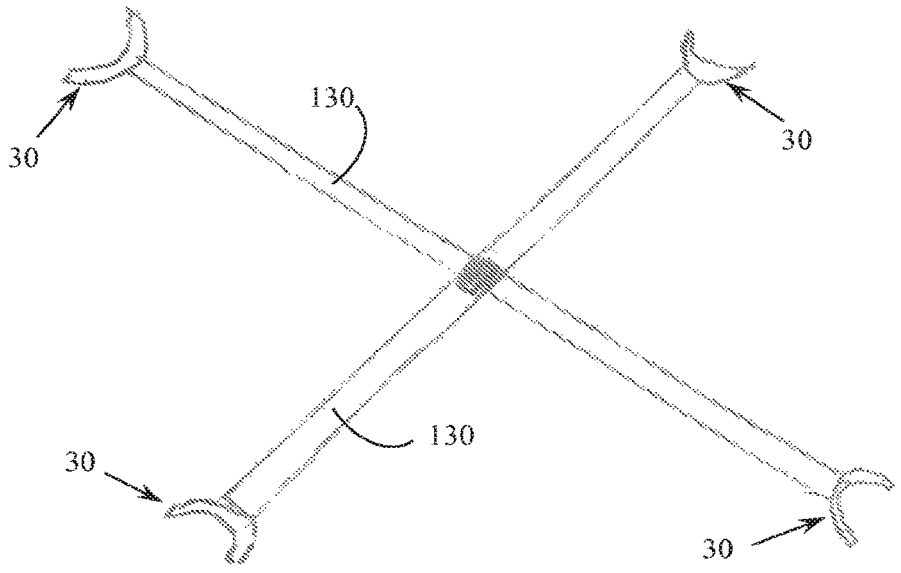
FIG. 9 is a schematic view of a frame assembly for a cover assembly in accordance with another preferred embodiment of the present invention.

FIG. 9 shows another embodiment of the frame assembly 20 which comprises two flexible 130 members arranged in an X configuration and having the mounting means 30 at each end thereof. The members 130 can then be bent in use and attached adjacent to corners or opposing portions of the bassinet top edge periphery 101.

In the embodiments of FIG. 6 to FIG. 9, the panel assembly 40 will be shaped according to the shape of the frame assembly, and can for example be a single piece dome-shaped panel. The panel assembly 40 is preferably attached to the frame assembly 20, but can also be provided separately therefrom or attachable thereto by suitable means. Free edges of the panel assembly 40 can also include means for temporary attachment to the bassinet such as temporary adhesive means or can include edge weights so that the edges can be positioned and retained in position as desired.

Figure 10:
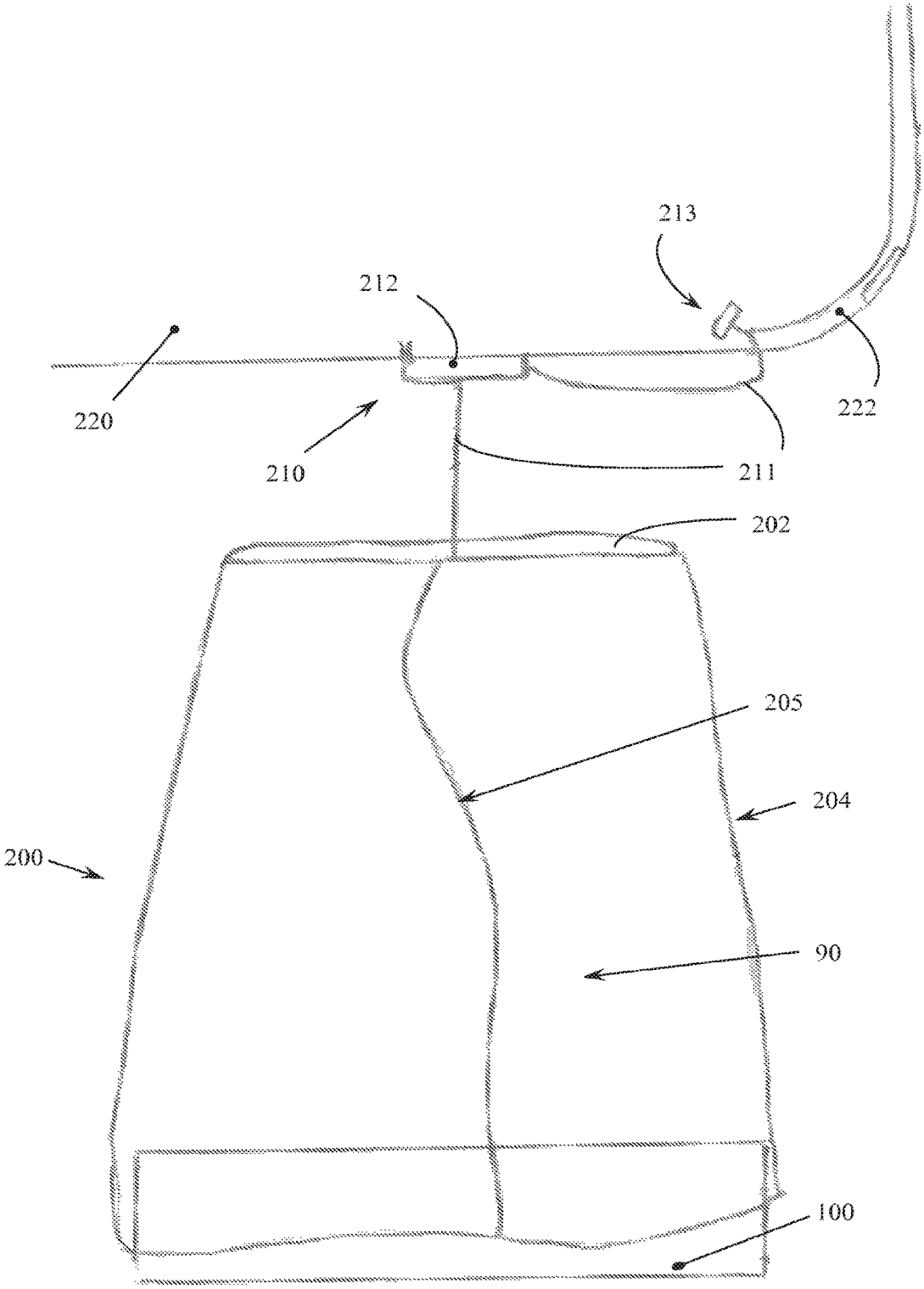
FIG. 10 is a front view of a cover assembly in accordance with another preferred embodiment of the present invention in use with an airplane bassinet.
Figure 11:
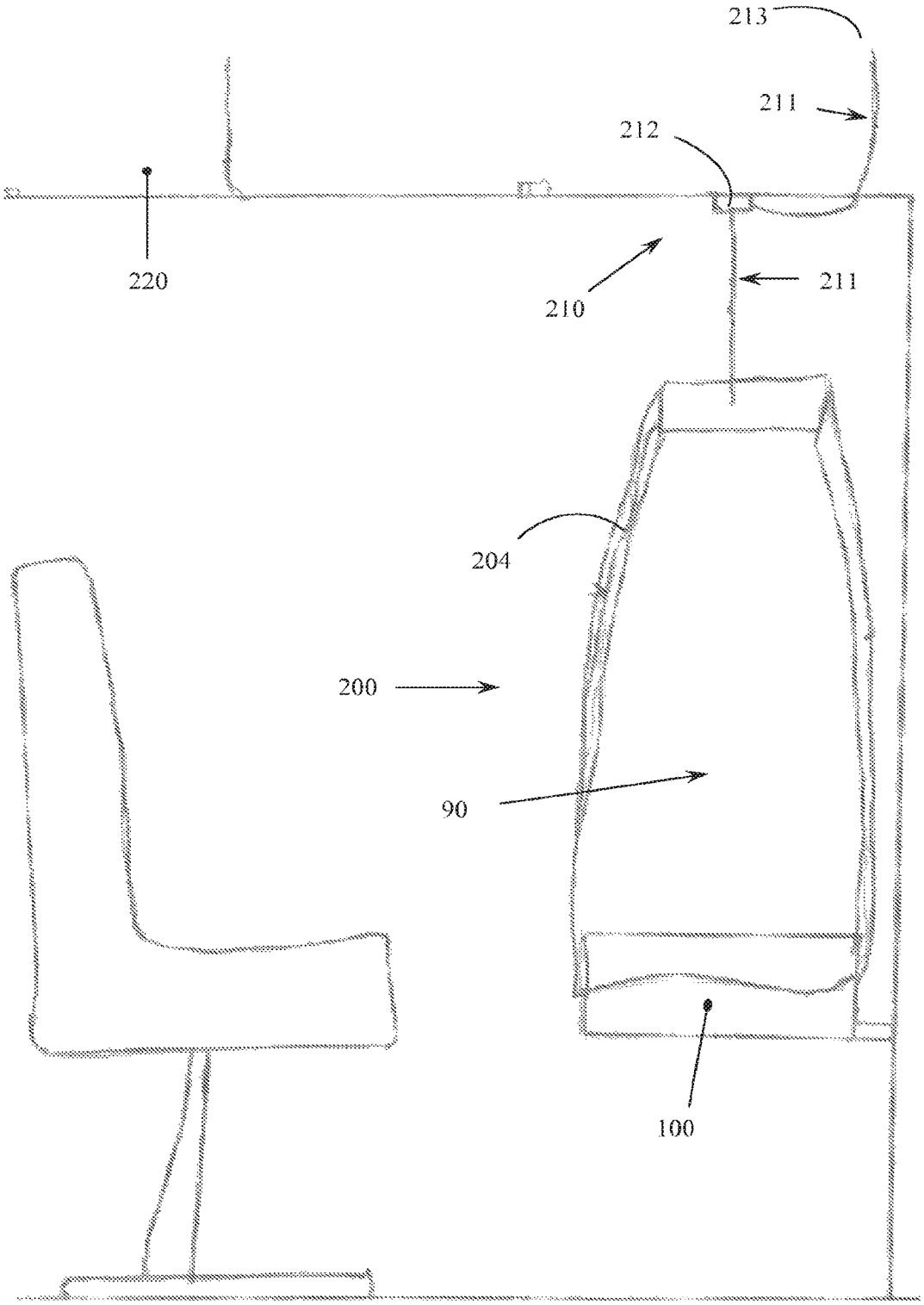
FIG. 11 is a side view of the cover assembly and airplane bassinet of FIG. 10.

FIG. 10 and FIG. 11 show an alternative cover assembly 200 which is intended for airplane bassinets. This cover assembly 200 comprises a flexible frame 202 supporting a panel assembly 204 which is dimensioned to provide a covered area 90 above the bassinet 100. The panel assembly 204 includes an overlap portion 205 to allow access to the infant. In this embodiment, the cover assembly 200 is mounted via a mounting means 210 which is attached to the overhead compartment 220 of the airplane. The mounting means comprises a length adjustable connector 211 attaching the frame 202 and/or the panel assembly 204 to a suction cup 212 which is attachable to the overhead compartment 220. The suction cup 212 is further attached to a safety clip 213 via the connector 211. The safety clip 213 is locked in use via the compartment door 222 as an additional means for holding the cover assembly 200 up in case the attachment of the suction cup 212 fails.

The present invention thus provides a cover assembly which reduces the distraction for infants during sleep. In airplane flights, this improves the flying experience for infants, parents and passengers alike. The cover assembly provides a 'tent' like covered area environment around and above the baby bassinet and shields the infant from the light and activity of the airplane cabin space. The cover assembly blocks out light and movement and provides a darkened environment and reduces the distraction of passers-by, air stewards serving food, overhead reading lights and main cabin lights. The covered area environment should enable the infant to rest more soundly and subsequently allow parents and fellow passengers a more relaxing travel experience. The cover assembly may also reduce the exposure of the infant to germs within the aircraft. It is apparent that the cover assembly can also be used for the other infant beds described above to provide the infant with a consistent darkened covered area if desired, whether at home, on the move or at another location.

The cover assembly provides several functions and benefits including: preventing unwanted light from disturbing the infant during sleep, provide suitable access to the infant for checking on and handling of the infant, be collapsible and foldable into a relatively small package for easy transport and handling, lightweight, breathable, and easy and intuitive to install. The cover assembly is preferably compliant with airline safety standards.

Desired indicia can also be added to the outer surfaces of the panel assembly to provide a particular theme or advertising as desired. Pockets can also be provided to the outer surface for personal belongings, including mobile phone or media players for playing music for the infant.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of the Invention are hereby expressly incorporated into this Detailed Description of the Invention, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the description provided herein, numerous specific details are set forth. However, it is understood that embodiments of the invention may be practiced without these specific details. In other instances, well-known methods, structures and techniques have not been shown in detail in order not to obscure an understanding of this description.

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Thus, while there has been described what are believed to be the preferred embodiments of the invention, those skilled in the art will recognise that other and further modifications may be made thereto without departing from the spirit of the invention, and it is intended to claim all such changes and modifications as fall within the scope of the invention.

Although the invention has been described with reference to specific examples, it will be appreciated by those skilled in the art that the invention may be embodied in many other forms.

It is apparent from the above, that the arrangements described are applicable to the baby goods, bedding and travel industries.

The claims defining the invention are as follows:

1. A cover assembly for an infant bed, the cover assembly comprising:

a frame assembly adapted for mounting to the infant bed and mounting means for attachment to opposite side edges of the infant bed, said frame assembly comprising a top frame, interconnected curved first and second side frames, wherein said curved first and second side frames each further include curved lateral members and longitudinal members, and at least one hinge pivotally connecting said longitudinal members;

a panel assembly supported by the frame assembly to define a covered area above the infant bed and extending around a periphery of the infant bed;

said panel assembly having a top panel, two front panels, a rear panel, two window panels disposed on opposite sides of said panel assembly, and an open bottom defined by lower edges of said front, rear and window panels;

said front panels being separated by a first opening and a first closure device joining said front panels along said first opening, said first closure device extending linearly along its length from lower edges of said front panels and towards said top panel;

each said window panel having a second opening and a second closure device formed along said second opening;

said window panels each having upper ends that extend towards one another at said top panel; and wherein said first and second closure devices are at least one of hook and loop fasteners, buttons, zippers, or complementary magnetic means.

2. The cover assembly of claim 1 wherein the mounting means are adapted to attach to upper edges of the infant bed.

3. The cover assembly of claim 1 wherein the mounting means comprises at least two clips.

4. The cover assembly of claim 1 wherein the panel assembly is made from a flexible breathable material.

5. The cover assembly of claim 1 wherein the panel assembly comprises an overlap portion.

6. The cover assembly of claim 1 wherein the cover assembly is foldable or collapsible.

7. The cover assembly of claim 1, wherein:

said panel assembly further includes a lower section disposed below each of said opposite window panels, said lower section extending from said window panel to front panels and to said rear panel.

8. The cover assembly of claim 1, wherein:

said window panels each have a triangular shape with upper ends that extend towards one another at said top panel.

* * * * *